United States Patent [19]

Ambrose

[11] Patent Number: 4,487,358

[45] Date of Patent: Dec. 11, 1984

[54] PARTITIONED CARTON AND BLANK WITH REINFORCED BOTTOM

[75] Inventor: Everett J. Ambrose, Hartford, Conn.

[73] Assignee: Continental Plastic Beverage Bottles, Inc., Stamford, Conn.

[21] Appl. No.: 420,057

[22] Filed: Sep. 20, 1982

[51] Int. Cl.[3] ..... B65D 5/48

[52] U.S. Cl. ..... 229/27; 229/28 R; 229/DIG. 11

[58] Field of Search ..... 229/27, 28 R, 15, DIG. 11; 206/602, 623

[56] References Cited

U.S. PATENT DOCUMENTS

| | | | |
|---|---|---|---|
| 1,737,950 | 12/1929 | Scotland | 229/27 |
| 1,898,231 | 2/1933 | Weiss | 229/27 |
| 2,850,224 | 9/1958 | Meinhardt et al. | 229/27 |
| 2,983,421 | 5/1961 | Turpin | 229/17 R |
| 2,998,179 | 8/1961 | Zilles | 229/27 |
| 3,049,279 | 8/1962 | Mairs et al. | 229/27 |
| 3,199,762 | 8/1965 | Coons | 229/27 |
| 3,228,581 | 1/1966 | Stegner | 229/27 |
| 3,365,112 | 1/1968 | Priest et al. | 229/23 R |
| 3,492,133 | 1/1970 | Milne et al. | 229/27 X |
| 3,510,046 | 5/1970 | Reiner | 229/27 |
| 3,977,592 | 8/1976 | Gorham | 229/28 R |
| 4,293,091 | 10/1981 | Gerard | 229/27 |

FOREIGN PATENT DOCUMENTS

| | | | |
|---|---|---|---|
| 13138 | of 1901 | Sweden . | |
| 2086850 | 5/1982 | United Kingdom | 229/27 |

*Primary Examiner*—William Price
*Assistant Examiner*—Gary E. Elkins
*Attorney, Agent, or Firm*—Charles E. Brown

[57] ABSTRACT

This relates to a box particularly adapted to have packed therein bottles and most particularly two liter bottles although it is adaptable to packages of smaller bottles. The box incorporates a partition panel which is provided at one end with a securing flap and at the opposite end is connected to a partial side wall panel which has joined thereto in overlapped relation a second partial side wall panel. The width of the overlap between the side wall panels and the width of the securing flap are such that the resultant columnar strength is sufficient to permit stacking without damage during transport. Further, the overlap of the side wall panels carries forth to a bottom closing flap carried by those side wall panels so as to provide for a reinforced bottom which will support the bottles.

3 Claims, 7 Drawing Figures

FIG. 4
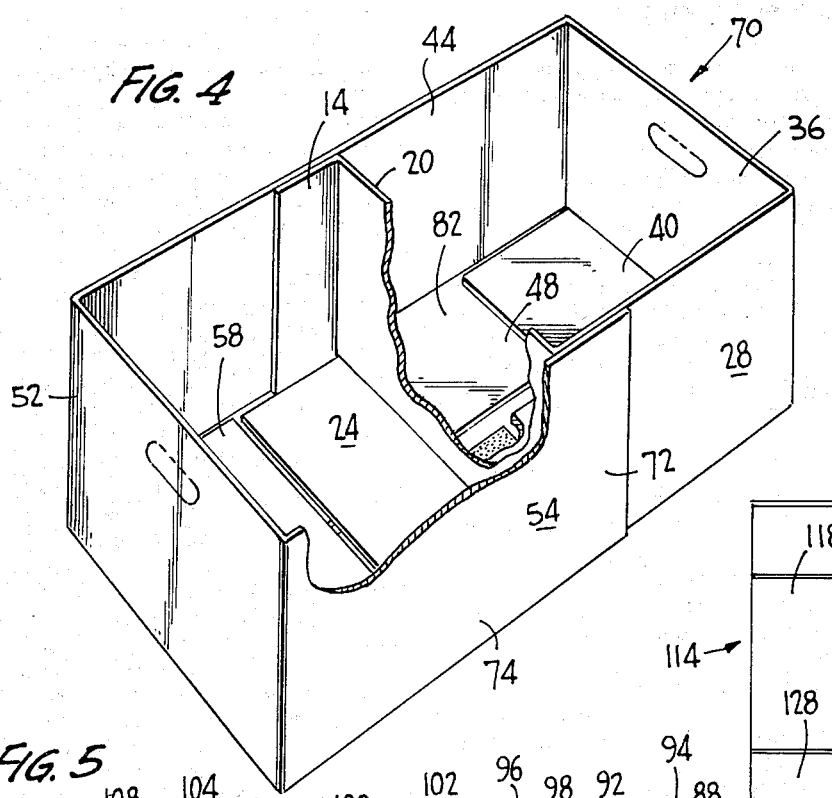
FIG. 7
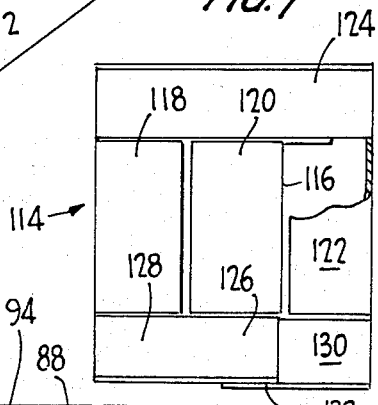
FIG. 5
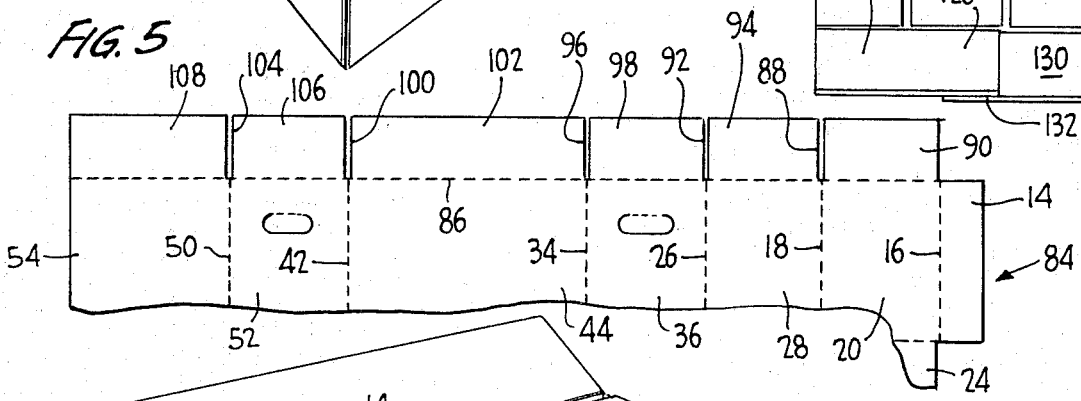
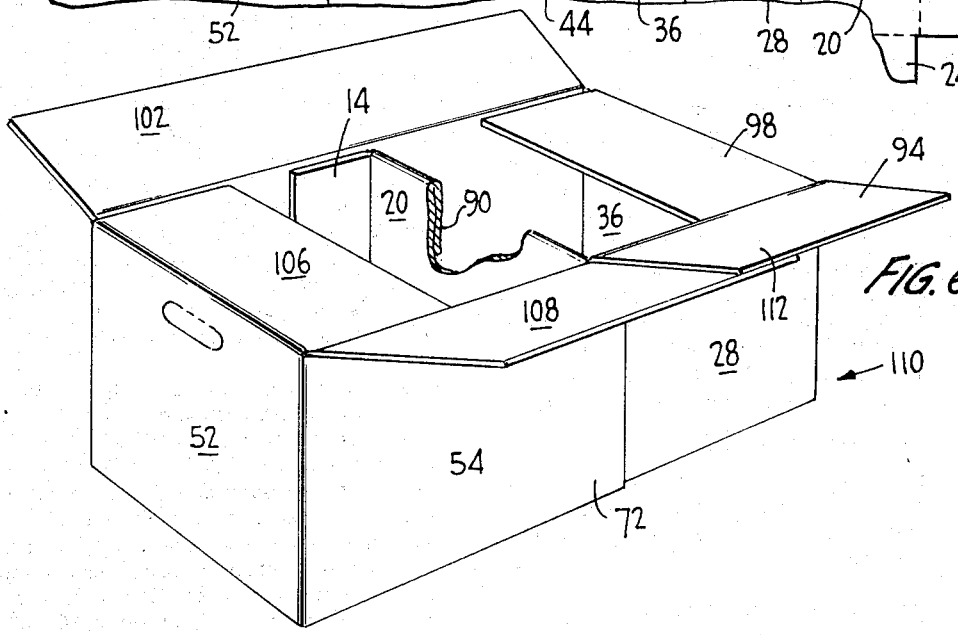
FIG. 6

PARTITIONED CARTON AND BLANK WITH REINFORCED BOTTOM

This invention relates in general to new and useful improvements in cartons, and more particularly to a carton for the shipment of beverage bottles, both empty and filled with a beverage.

There has been developed in the past a carton or box specially for the purpose of the present invention. Such a box is disclosed in U.S. Pat. No. 4,293,091 to Gerard with the box having panels 15, 16 and 17, the panel 16 being a partition panel and the panels 15 and 17 being securing panels. It will be seen that the panels 15, 16 and 17 are not provided with bottom closing flaps. Thus the carton, while it has ample stacking strength, does not have a sufficient bottom strength, particularly when the bottom of the box gets wet and bottles will fall through the bottom.

There is also on the market a further box similar to the Gerard box but wherein the panels corresponding to the Gerard panels 15 and 17 have a width only on the order of one inch, i.e., only that required to obtain a good bond between the overlapped portions. Such a box does not have sufficient stacking strength and further does not have sufficient bottom strength.

In accordance with this invention, it has been found that if one forms the equivalent of panels 11 and 17 of Gerard to provide an overlap on the order of three inches or possibly as much as four inches and if one provides a bottom forming panel on each of the equivalent of the panels 15 and 16 of Gerard, the desired stacking strength as well as the desired bottom strength can be obtained with a much lesser weight corrugated board, the boxes in all instances being normally formed of corrugated board.

Most particularly, by providing the partition panel with a bottom closing flap, and by folding that bottom closing flap to a position remote from the overlap of the side panels, a bottom closing flap which is carried by the overlapping side panel portions serves to partially close the bottom of the box in that single space not reinforced by bottom forming flaps carried by the end panels and the partition panel or wall.

It has also been found that the erected box formed in accordance with this invention is on the order of one-half inch less in length with the result that a much larger number of boxes filled with bottles may be loaded in a standard size truck providing a savings in shipment.

Finally, with the reinforced bottom construction, there is a material savings in bottle damage.

With the above and other objects in view that will hereinafter appear, the nature of the invention will be more clearly understood by reference to the following detailed description, the appended claims, and the several views illustrated in the accompanying drawings.

IN THE DRAWINGS

FIG. 3 is a bottom plan view of the box of FIG. 2 with parts broken away and shows further the bottom construction of the box.

FIG. 4 is a top perspective view of the box of FIG. 2 with parts broken away and showing a section that shows further details of the box.

FIG. 5 is a fragmentary plan view of a blank similar to of FIG. 1 but wherein the blank is provided with top closing flaps.

FIG. 6, is a top perspective view of a box formed from the blank of FIG. 5 in a partially erected state with parts broken away and showing a section.

FIG. 7 is a bottom view of still another form of box in its partially erected state with parts broken away and showing a section.

Figure 1:
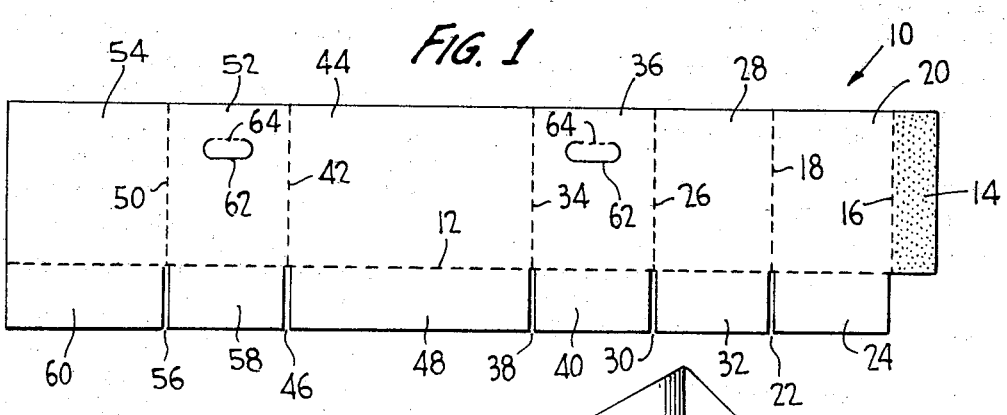
FIG. 1 is a plan view of a blank from which a carton or box in accordance with this invention is formed.

Referring now to the drawings in detail, it will be seen that there is illustrated in FIG. 1 a carton or box blank formed in accordance with this invention, the blank being generally identified by the numeral 10. The blank 10 is in the form of an elongated section of corrugated board which is provided with a series of transverse fold and cut lines and a further longitudinal fold line dividing the blank into a plurality of panels some of which form box or container walls and some of which form bottom closing flaps. Most specifically, the blank includes a longitudinal fold line 12 which divides the blank 10 into bottom closing flap portions and wall portions. At the right end of the blank 10 there is a securing flap 14 which is set off by a transverse fold line 16. Spaced from the transverse fold line 16 is a transverse fold line 18 with there being a partition wall panel 20 between the fold lines 16 and 18.

In alignment with the fold line 18 is a transverse cut line 22 which sets off a bottom closing flap 24.

The blank 10 next has a transverse fold line 26 spaced on the fold line 18 and in combination with the fold line 18 setting off a partial side wall panel 28. A transverse cut line 30 forms a continuation of the fold line 26 and together with the cut line 22 defines a bottom closing flap 32.

Adjacent to and spaced from the transverse fold line 26 is a transverse fold line 34 which, in combination with the transverse fold line 26 sets off an end wall panel 36. Aligned with the fold line 34 is a cut line 38 which in combination with the cut line 30 defines a bottom closing flap 40.

The blank 10 also has a transverse fold line 42 which in combination with the fold line 34 sets off a side wall panel 44. A transverse cut line 46, which is aligned with the fold line 42, in combination with the cut line 38 defines a bottom closing flap 48. Finally, there is a transverse fold line 50 which, in combination with the fold line 42, defines another end wall panel 52. It also sets off a terminal partial side wall panel 54. A transverse cut line 56 is aligned with the fold line 50 and in combination with the cut line 46 defines a bottom closing flap 58. There is also hingedly connected to the partial side wall panel 56 along the longitudinal fold line 12, a bottom closing flap 60.

If desired, the end wall panels 36 and 52 may be provided with C-shaped cuts 62 in combination with a fold line 64 so as to define a handhole.

Figure 2:
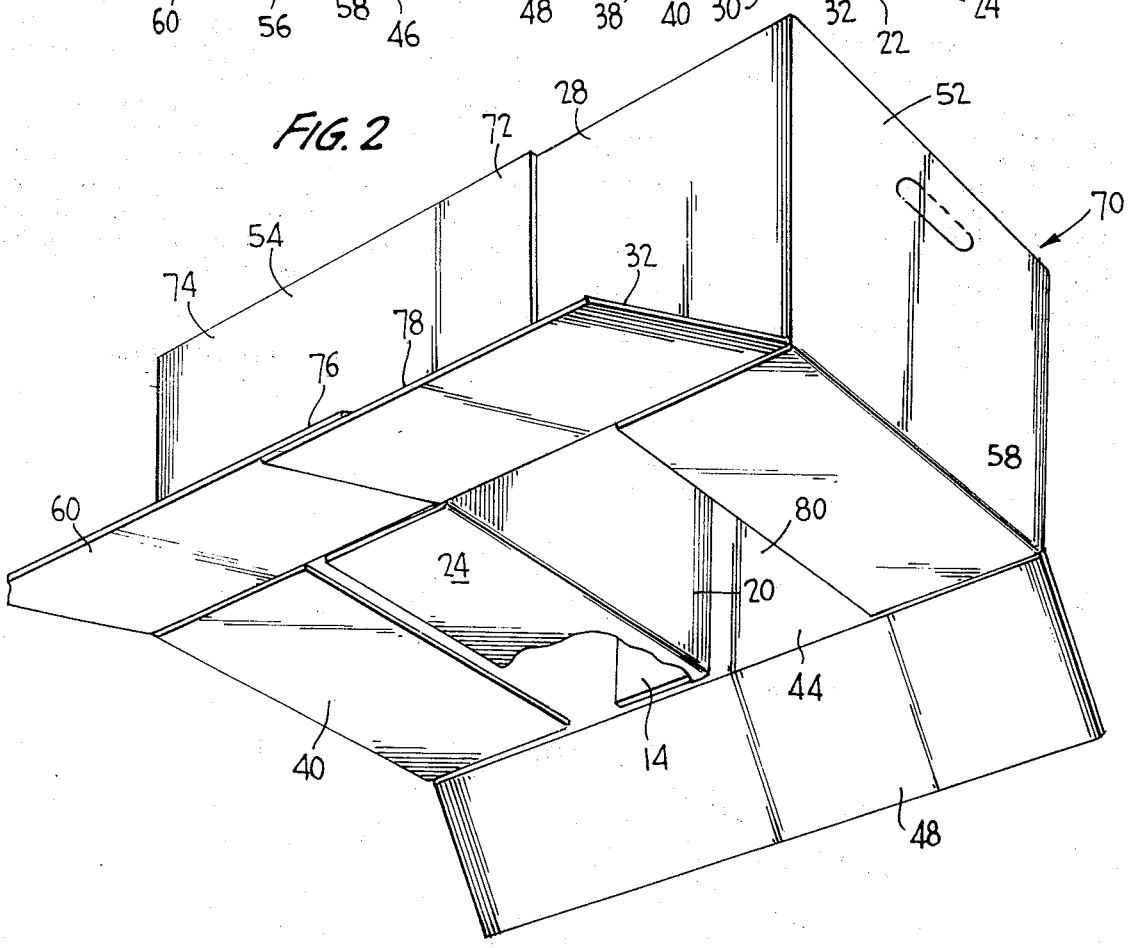
FIG. 2 is a bottom perspective view with parts broken away of a partially erected box formed from the blank of FIG. 1.

Referring now to FIG. 2, it will be seen that in the formation of a carton or box 70 in accordance with this invention, the partial side wall panels 54 and 28 are brought into partial overlapping relation and are adhesively bonded together to define an overlap 72. The overlap 72 extends down to the bottom of the resultant side wall 74 and has a continuation 76 and a bottom closing flap 78 which is formed by overlapped portions of the bottom closing flaps 32 and 60.

It will also be seen that the partition wall 20 extends transversely of the carton or box 70 with the securing flap 14 being adhesively secured to the innerface of the side wall 44.

As is clearly shown in FIG. 3, the securing flap 14 is disposed on one side of the partition wall 20 while the overlaps 72 and 76 are on the opposite side.

It is also to be understood that with the parts of the carton or box so adhesively bonded, the carton or box 70 may be folded to a flat state.

In an erection of the carton or box 70, it is moved to its open state, after which the bottom closing flaps are folded inwardly to partially define a bottom, as is clearly shown in FIG. 2. This, however, leaves open space 80 between the bottom closing flap 58 and the bottom closing flap 24. However, when the bottom closing flaps 48 and 78 are folded to complete the bottom, as shown in FIG. 3, it will be seen that the overlap 76 is aligned with one-half of the space 80 and therefore provides a very strong bottom notwithstanding that the bottom is not of a double construction throughout.

With reference to FIG. 4, it will be seen that only the area 82 of the bottom is not of a reinforced construction. However, when the box 70 is used to transport, for example, eight two liter bottles, only one of the bottles will be aligned with the bottom space 82 and its weight would not be sufficient to cause the bottom to open and permit the bottle to be accidentally discharged.

Most specifically, in accordance with this invention the securing flap 14 and the overlap 72, as well as the overlap 76 has a width on the order of three to four inches. By providing this width of reinforcement in the central portion of the side walls of the box on opposite sides of the partition panel 20, the necessary columnar strength in the central part of the box is obtained so that the box, filled with bottles, may be stacked the desired height for shipment. With respect the full width overlap as found in the above-referred to U.S. Pat. No. 4,293,091, there is a material saving of corrugated board. On the other hand, with respect to the prior art box, wherein the width of the securing flap 14 and the overlap 72 is only that required for the effective bonding, one inch, slightly more corrugated board is required. However, it has been found with the specific box construction of FIGS. 1 through 4, which box is intended to carry eight two liter bottles filled with a liquid product, the corrugated board may be formed with only 26# mediums is as strong as the standard box with heavier 33# mediums. This means that the box in accordance with this invention may be cheaper (5¢/-case) than prior boxes and still have the necessary strength for general commercial service under most adverse conditions. In addition to the savings in cost, the increased strength of the box will permit users to avoid stacking and truck handling losses in that the bottles will now not fall through the overlapped bottom construction.

The cost saving in boxes alone for a customer shipping 2.0 M bottles per month equates to $150,000/year. Handling failures during trucking for the same bottler were estimated in 1981 to be over $100,000. Based upon these savings alone, with the 1983 production forecast, there could be a savings on the order of $1.0–$2.0 M per year.

It is to be understood that the box of this construction will be replacing most commercially used I-beam (or H-beam) boxes which have an interior partition with two flaps at each end of the open box. Since these flaps in a standard construction take $\frac{1}{4}$ inch (with insertion tolerance) in thickness, the box length is thus almost one-half inch longer than the box of this construction. Also, the double thickness of the beam down the middle of the box lengthwise, makes the test box about $\frac{3}{8}$ inch wider than the box. Thus, a box formed in accordance with this invention would be 18 inches long by 9 inches wide. When the boxes are stacked on large 44 inch by 56 inch pallets with two lengths plus one width across the load it is only 45 inches wide total. Trucks are loaded with two pallets across a 92 inch wide truck which leaves two inches open clearance between pallets as shipped. This is sufficient for easy loading of pallets without damage to boxes. With the commonly used I-beam box having a length of $18\frac{1}{2}$ inches and a width of $9\frac{3}{8}$ inches, the extra truck length required for the two loads would be $\frac{1}{2}\times 4$ plus $\frac{3}{8}$ inch$\times 2$ or $2\frac{3}{4}$ inches. Thus, using the I-beam box, not as many boxes can be loaded in a commercial truck. In the past, one could only load 1,540 8-Pak cases into a 45 foot truck. However, with the box of this invention, one can pack in the same truck 1,890 of such cases. It is estimated that this could result in a savings of as much as $2.0 M for the industry based upon 1983 production forecast.

Referring now to FIG. 5, it will be seen that there is illustrated a modified form of blank which is identified by the reference numeral 84. The blank 84 is identical to the blank 10 except it is provided with top closing flaps. Thus the blank 84 is wider than the blank 10 and is provided with a second longitudinal fold line 86 which is parallel to the fold line 12.

The blank 84 has in alignment with and as a continuation of the fold line 18 a cut line 88 which sets off a reinforcing flap 90 carried by the partition panel 20. A cut line 92, which is aligned with the fold line 26, in combination with the cut line 88 sets off a top closing flap 94 which is carried by the partial side wall panel 28.

Another transverse cut line 96, which is in alignment with the fold line 34, in combination with the cut line 92, sets off a top closing flap 98 which is carried by the end wall panel 36. A transverse cut line 100 is aligned with the fold lines 42 and in combination with the cut line 96 sets off a top closing flap 102 which is carried by the side wall panel 44. Finally, there is a transverse cut line 104 which is aligned with fold line 50. The cut line 104; in combination with the cut line 100 defines a top closing flap 106 which is carried by the end wall panel 52. The cut line 104 also defines a top closing flap 108 which is carried by the partial side wall panel 54.

Referring now to FIG. 6, it will be seen that the box 110, during the formation thereof, has the reinforcing flap 90 reversely turned on the partition wall 20 so as to increase the columnar strength of the partition panel 20. At the same time, edge portions of the flaps 94 and 108 will be overlapped as at 112 and adhesively bonded together. The overlap 112 will be a continuation of the overlap 72.

The top of the box 110 is closed in the customary manner by evenly folding the flaps 98 and 106 and then inwardly folding the flap 102 and the combined flaps 94 and 108.

It is to be understood that while the most advantageous savings may be obtained with respect to a box particularly adapted to receive eight two liter bottles or the like, it is to be understood that the box construction may be advantageously utilized in other environments and, accordingly, there is illustrated in FIG. 7 a box embodiment wherein six two liter bottles may be packaged, this box being generally identified by the numeral 114. The box 114 will be of a construction similar to that of the box 70 except that the length will be only 1½ times the width. Further, a transverse partition wall 116 will be positioned at the third point. Thus in the bottom construction of the box 114, the bottom will have an initial closure defined by a bottom closing flap 118 carried by one end wall, a bottom closing flap 120 carried by the partition wall 116 and a bottom closing flap 122 carried by the other end wall. One side wall will carry a longitudinal bottom closing flap 124 while the other side wall, which will be formed of two panels, such as the side walls 74 and the box 70 will carry a second longitudinal bottom closing flap 126 which will be formed of two flaps 128 and 130 having an overlap 132.

Although only several preferred embodiments of the invention have been specifically illustrated and described herein, it is to be understood that minor variations may be made in the blank and box construction without departing from the spirit and scope of the invention as defined by the appended claims.

I claim:

1. A carton blank comprising a sheet of corrugated board cut and die stamped to form in sequence a securing flap, a partition wall, a partial side wall, an end wall, a side wall, another end wall and a terminal partial side wall, each of said walls having a bottom closing flap foldably connected to a like edge thereof; said blank being improved by said securing flap being of a length and said partial side wall and said terminal partial side wall being of a combined length to define an overlap thus to provide a columnar strength to a resultant carton on opposite sides of said partition wall with a combined minimum use of corrugated board and minimum board weight, said side wall having a length on the order of twice the length of said end walls, and said bottom closing flaps carried by said partial side wall being positioned to have in the resultant carton an overlap aligned with a bottom space void of one of saiid bottom closing flaps carried by said end walls and said partition wall.

2. A stackable shipping carton comprising side and end walls, a bottom closing flap carried at a lower edge of each of said side and end walls, a transverse partition wall extending between said side walls, and a bottom closing flap carried at a lower edge of said partition wall, said bottom closing flaps all being of the same dimension away from the respective wall which carries it; the improvement wherein one of said side walls is formed of two panels with an overlap adjacent said partition wall at one side thereof and said partition wall has a securing flap secured to the other of said side walls at the opposite side of said partition wall, the widths of said overlap and said securing flap being greater than that required for the required bond, and said overlap and said securing flap forming stacking columns on opposite sides of said carton intermediate ends of said carton, said carton having a length on the order of twice the width, said bottom closing flaps carried by said end walls closing one-half of the bottom of said carton, said bottom closing flap carried by said one side wall being also formed of two panels having an overlap of the same width as the first mentioned overlap, said bottom closing flap carried by said partition wall closing a further one-quarter of the bottom of said carton leaving remaining one-quarter of the bottom of said carton open except for said bottom closing flaps carried by said side walls, and said bottom closing flap carried by said one side wall having its overlap aligned with said remaining one-quarter of said bottom.

3. A carton in accordance with claim 2 wherein said carton is of a width to receive two bottles of a preselected size and of a length to receive four bottles of said preselected size.

* * * * *